United States Patent [19]

Imoto et al.

[11] Patent Number: 4,735,185

[45] Date of Patent: Apr. 5, 1988

[54] APPARATUS FOR FEEDING HIGH-PRESSURE FUEL INTO ENGINE CYLINDER FOR INJECTION CONTROL

[75] Inventors: Yuzo Imoto, Kariya; Hideo Wakata, Nagoya; Kiyonori Sekiguchi, Aichi, all of Japan

[73] Assignee: Nippondenso Co., Ltd., Kariya, Japan

[21] Appl. No.: 873,597

[22] Filed: Jun. 11, 1986

[30] Foreign Application Priority Data

Jun. 14, 1985 [JP] Japan ..... 60-129239

[51] Int. Cl.[4] ..... F02B 15/00

[52] U.S. Cl. ..... 123/498; 123/499; 417/322; 417/259

[58] Field of Search ..... 123/498, 499, 478; 417/322, 259

[56] References Cited

U.S. PATENT DOCUMENTS

| | | | |
|---|---|---|---|
| 1,822,242 | 9/1931 | Schongut | 417/259 |
| 2,006,572 | 7/1933 | Freeeman | 417/259 |
| 2,293,684 | 8/1942 | Holthouse | 417/259 |
| 2,669,186 | 2/1954 | Parker | 417/259 |
| 3,044,401 | 7/1962 | Sawyer | 123/499 |
| 3,303,787 | 2/1967 | Inman | 417/259 |
| 3,381,616 | 5/1968 | Wertheimer | 417/259 |
| 3,418,980 | 12/1968 | Benson | 123/498 |
| 3,753,426 | 8/1973 | Lilley | 123/498 |
| 3,809,507 | 5/1974 | Baglai | 417/259 |
| 4,082,481 | 4/1978 | Fenne | 123/498 |
| 4,555,718 | 11/1985 | Aiba | 417/322 |

FOREIGN PATENT DOCUMENTS

| | | | |
|---|---|---|---|
| 59-69578 | 4/1984 | Japan . | |
| 59-183069 | 10/1984 | Japan | 123/498 |
| 1484674 | 9/1977 | United Kingdom | 417/259 |

*Primary Examiner*—Ronald B. Cox

*Attorney, Agent, or Firm*—Cushman, Darby & Cushman

[57] ABSTRACT

A fuel injection control apparatus includes a booster apparatus, in which a cylinder chamber is divided into first and second fluid chambers by a piston. The operative area of the piston facing the first fluid chamber is sufficiently greater than that facing the second fluid chamber. Pressurized fuel is supplied to the first fluid chamber through a first check valve. The fluid is delivered from a second fluid chamber to a fuel injection valve via a second check valve. A fluid passage is formed between the first and second fluid chambers. A third check valve is set in the fluid passage, whereby the fuel is allowed to flow only from the first fluid chamber toward the second fluid chamber. The booster piston is located by means of a first piezoelectric device which includes a plurality of piezoelectric elements stacked in layers. When high voltage is applied to the first piezoelectric device to extend it, the piston is moved toward the first fluid chamber. High-voltage power from a second piezoelectric device, which faces the inside of an engine cylinder, is supplied to the first piezoelectric device via a backflow-preventing element. The first piezoelectric device is controlled for discharge in response to the injecting timing.

12 Claims, 3 Drawing Sheets

APPARATUS FOR FEEDING HIGH-PRESSURE FUEL INTO ENGINE CYLINDER FOR INJECTION CONTROL

BACKGROUND OF THE INVENTION

The present invention relates to an apparatus for feeding a high-pressure fluid, in which fuel is injected, in response to the fuel injection timing, into each cylinder of a diesel engine, from a fuel injection valve attached to the cylinder, and more specifically to a fuel injection apparatus using piezoelectric elements for fuel injection control.

As an example of conventional apparatuses for feeding a high-pressure fluid, there is a system which feeds and injects fuel into, e.g., each cylinder of a diesel engine. In this fuel injection system, the fuel discharged from a fuel injection pump, which is driven by the engine, is fed to a fuel injection valve in response to the injection timing. The fuel delivery, injection timing, etc., are adjusted to optimum conditions for the operating state of the engine. The establishment of these conditions requires sophisticated adjusting mechanisms, such as a governor and timer mechanism.

As a means of settling this problem, for example, an actuator mechanism using piezoelectric elements is disclosed in Japanese Patent Disclosure No. 183069/84. This mechanism, which serves for combined use with fuel injection valve and fuel injection pump, controls the voltage applied to the piezoelectric elements, thereby extending or contracting the elements. Thus, the fuel injection timing, as well as injection quantity, can be determined properly.

The piezoelectric elements constituting the actuator mechanism are extended when supplied with high voltage. Therefore, they can effectively be utilized for the execution of a delicate, high-speed action, in particular.

When using these piezoelectric elements for the arrangement of, for example, a pump, high voltage is applied to the elements to extend them for pump discharge. Thus, although the pump including the piezoelectric elements has a high-speed response characteristic, its actual discharge efficiency depends on the instantaneous current supply capability of its drive power source. In other words, the operating characteristic of the pump using the piezoelectric elements is determined by the capacity of a power circuit of the elements. If a fuel injection apparatus is constructed by the use of the piezoelectric elements, for example, a large-scale, high-voltage power source unit is required, which can instantaneously supply a large current to the piezoelectric elements which serve as a source of injection power for the apparatus.

The extension of the piezoelectric elements supplied with the high voltage is influenced by temperature, frequency of applied voltage, and the like. When using these elements in the fuel injection apparatus, therefore, it is difficult to maintain steady injection characteristics.

SUMMARY OF THE INVENTION

It is an object of the present invention to provide an apparatus capable of supplying a high-pressure fluid, by means of piezoelectric elements which are extended or contracted by controlling voltage applied thereto, and more specifically, a fuel injection control apparatus which feeds high-pressure fuel to, for example, each fuel injection valve of a diesel engine, in response to the injection timing, for an injection operation of the injection valve.

Another object of the invention is to provide a high-pressure fluid supply apparatus of simple construction, using a miniaturized power source unit for extending the piezoelectric elements.

Still another object of the invention is to provide a fuel injection control apparatus adapted for use with a diesel engine mounted in a vehicle, in which part of the diesel engine is utilized for accommodating the power source unit of the piezoelectric elements, in injecting fuel into the engine.

A further object of the invention is to provide a fluid supply apparatus capable of steadily fulfilling its functions, such as the fuel injection function, without being influenced by temperature or other environmental conditions.

According to the present invention, there is provided an apparatus for feeding a high-pressure fluid, which mainly comprises a booster pump. The pump is constructed so that a first piezoelectric device, including a plurality of piezoelectric elements stacked in layers, is contracted when applied voltage is removed therefrom. As the device is contracted in this manner, a piston is driven so that the fluid pressure is boosted. The piezoelectric elements, constituting the first piezoelectric device, are normally kept extended by high-voltage power generated in a second piezoelectric device, which is set in, for example, a combustion chamber of the engine, by pressure produced during the explosion process of the engine. The high voltage applied to the first piezoelectric device is discharged in response to the timing for fluid supply, e.g., fuel injection timing. Thus, the piezoelectric elements are contracted to drive the piston.

In a fuel injection apparatus as an example of supply apparatus constructed in this manner, high voltage is generated in the second piezoelectric device during the explosion process of the engine, and supplied to the first piezoelectric device of the booster pump. As a result, the first piezoelectric device is extended to provide a stand-by state for fuel injection. If a discharge circuit is formed by, for example, shorting a high-voltage impression circuit of the first piezoelectric device at an injection timing immediately before the explosion process, the high voltage is discharged from the device. In consequence, the first piezoelectric device is contracted to drive the piston for an action of fuel injection.

Thus, the first piezoelectric device can be extended in the stand-by state without requiring any special high-voltage power source. When the device is contracted by the electric discharge, the piston is driven to perform a fluid supply operation. In other words, the fluid or fuel can stably be supplied or injected without utilizing the extending action of the piezoelectric device which is susceptible to temperature change and the like.

DETAILED DESCRIPTION OF THE PREFERRED EMBODIMENTS

Figure 1:
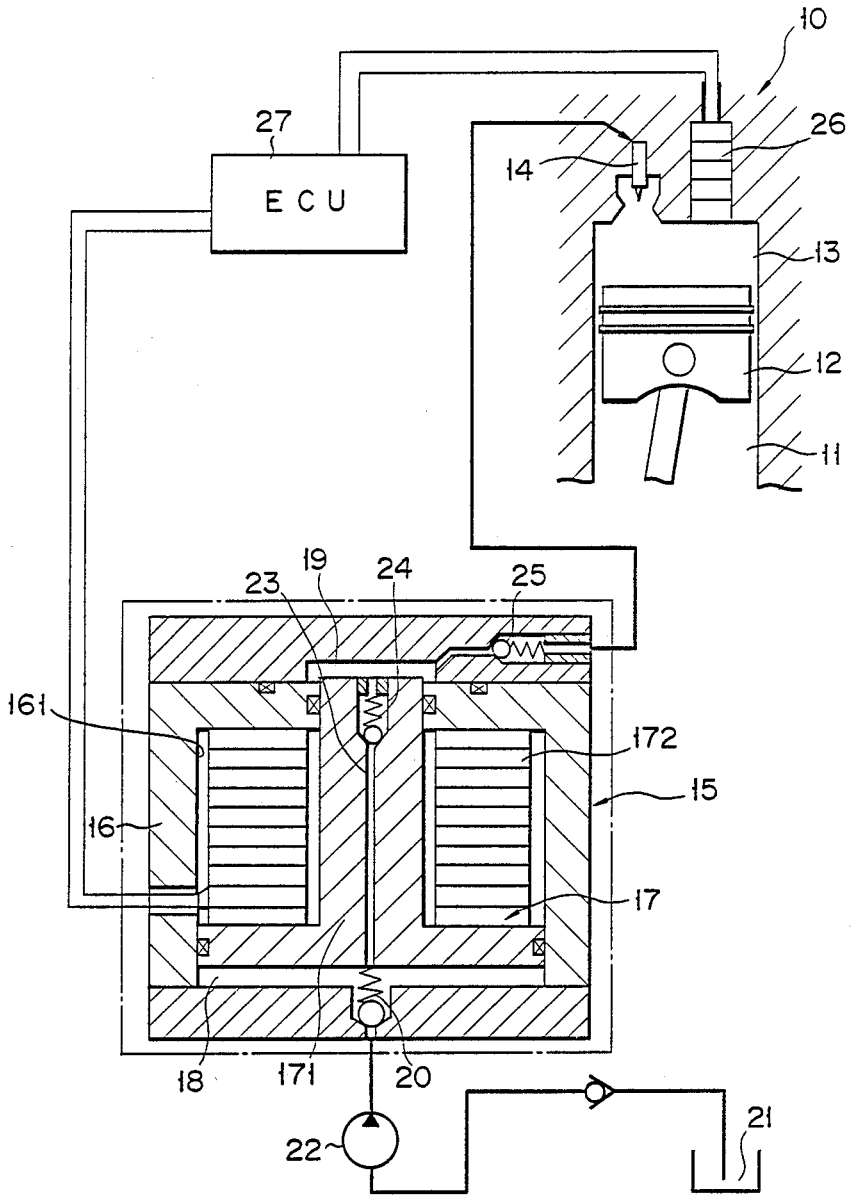
FIG. 1 is a schematic view for illustrating an arrangement of a fuel injection apparatus according to an embodiment of the present invention.

A first embodiment of the present invention will now be described in detail with reference to the accompanying drawings. This embodiment is applied to fuel injection apparatuses of a diesel engine which is mounted, for example, in an automobile. FIG. 1 shows one such apparatus which is coupled to one cylinder 11 of diesel engine 10. Fuel injection apparatuses of the same construction are provided individually for other cylinders of the engine.

Inside cylinder 11, piston 12 is connected to a crankshaft (not shown). It defines combustion chamber 13 in the cylinder. Fuel injection valve 14 is attached to the top portion of cylinder 11, opening into chamber 13. High-pressure fuel is supplied from booster pump 15 to valve 14, and injected into the combustion chamber 13 of the cylinder.

Thus, whe the high-pressure fuel is fed from booster pump 15, fuel injection valve 14 injects it into combustion chamber 13. The fuel pressure is set in pump 15, and the fuel is supplied to valve 14 in response to the fuel injection timing.

Booster pump 15 comprises container 16 in which cylinder 161 is defined. Piezoelectric piston mechanism 17 is contained in cylinder 161.

Piston mechanism 17 includes piston 171 located in cylinder 161 for axial movement and piezoelectric device 172 for driving piston 171. The piezoelectric device includes a set of laminar piezoelectric elements stacked in layers. Electrodes are interposed between the piezoelectric elements so that the elements are connected in parallel with one another by the electrodes. High-voltage is selectively applied to the piezoelectric elements.

Piston 171 defines first and second fluid chambers 18 and 19 in cylinder 161. In this case, second fluid chamber 19 is coaxial with cylinder 161 so that the former is sufficiently smaller in cross-sectional area than the latter. Cylinder 161 includes a first cylinder portion corresponding to first fluid chamber 18 and a second cylinder portion coaxial with the first cylinder portion and corresponding to chamber 19. The second cylinder portion is smaller enough in diameter than the first one. Piston 171 includes a body portion facing chamber 18 and a rod portion whose cross-sectional area is substantially equal to that of chamber 19. Thus, the pressure receiving area of piston 171 facing first fluid chamber 18 is sufficiently greater than that facing second fluid chamber 19. First piezoelectric device 172, including the set of piezoelectric elements in the form of a cylinder, is fitted on the rod portion of piston 171. In this case, device 172 is interposed between the body portion of piston 171 and the end face portion of cylinder 161 which corresponds to the outer peripheral portion of second fluid chamber 19. When device 172 is extended, piston 171 is driven toward first fluid chamber 18. Normally, piston 171 is urged toward second fluid chamber 19 by the pressure inside chamber 18.

Fuel from fuel tank 21, whose pressure is raised by pressurizing pump 22, is fed into first fluid chamber 18 via check valve 20. Chamber 18 is always kept filled up with the fuel under a predetermined pressure Piston 171 is formed within fluid passage 23 which connects first and second fluid chambers 19. Passage 23 is provided with check valve 24 which allows a fluid to flow only from chamber 18 toward chamber 19. Chamber 19 is formed with an output passage which is provided with check valve 25. Output fuel from the output passage is supplied to fuel injection valve 14. Valve 25 is adjusted so as to allow the flow of only the fluid delivered from second fluid chamber 19.

When piezoelectric device 172 of piezoelectric piston mechanism 17 is extended so that piston 171 is located on the side of first fluid chamber 18, the fuel in chamber 18 is fed into second fluid chamber 19 to fill it, through fluid passage 23. When device 172 is contracted, piston 171 is driven toward chamber 19 by the pressure inside chamber 18, since the pressure receiving area of piston 171 facing chamber 18 is greater than that facing chamber 19. In consequence, the fuel in second fluid chamber 19 is discharged via check valve 25, and then injected into combustion chamber 13 of cylinder 11, through fuel injection valve 14.

A chamber opens into combustion chamber 13 of cylinder 11 of the engine described above. It contains second piezoelectric device 26 which opens into chamber 13. Device 26 is adapted to be subjected to a pressure which is produced when explosion takes place in chamber 13. If the explosion pressure is applied to it, device 26 produces high voltage. A voltage delivered from device 26 during the process of explosion in chamber 13, is supplied as an explosion detection signal to engine control unit 27. High-voltage power generated by the explosion is fed to unit 27, thus serving as a drive power source for first piezoelectric device 172 of booster pump 15. Control voltage to be supplied to device 172 is obtained from unit 27.

Engine control unit 27 is formed of, e.g., a microcomputer (not shown in detail). It provides engine control information, such as injection quantity, and delivers a control output in accordance with the intake air quantity, engine speed, throttle valve opening, etc. In this embodiment, unit 27 also serves to control the voltage applied to first piezoelectric device 172 of piezoelectric piston mechanism 17.

Figure 2:
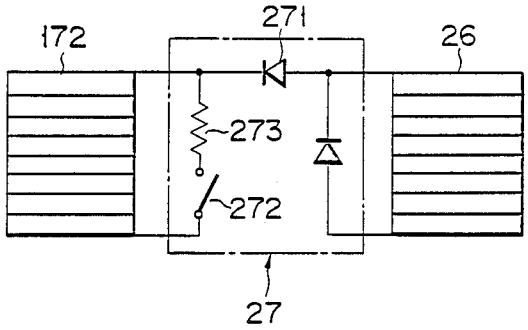
FIG. 2 is a diagram for illustrating a power source for applying high voltage to a piezoelectric device used in the apparatus of FIG. 1.

FIG. 2 is a circuit diagram showing control means, in engine control unit 27, for controlling the voltage applied to first piezoelectric device 172. The voltage produced by second piezoelectric device 26 is supplied to device 172 via diode 271 as a backflow-prevention element. When the pressure produced during the explosion in combustion chamber 13 is applied to device 26, a voltage is produced by device 26. This voltage is applied to first piezoelectric device 172 to cause it to be extended. In this case, no electricity is discharged from device 172, so that device 172 is kept extended.

Switch element 272 is provided so that the input terminal portion of the power source of first piezoelectric device 172 is short-circuited. The switch element 272 is activated in response to an instruction for fuel injection. When it is turned on, a discharge circuit is formed for the voltage which has so far been applied to device 172. Thus, upon activation of switch element 272, the first piezoelectric device is contracted.

Figure 3A:
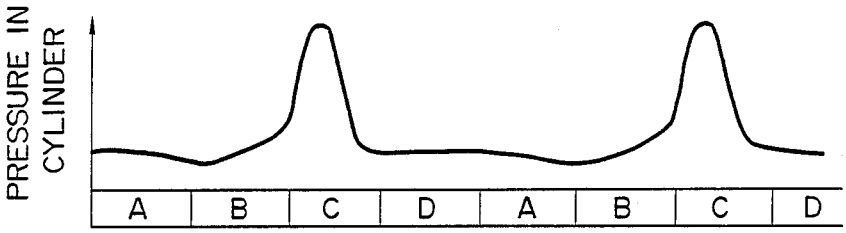
FIGS. 3A, 3B and 3C show performance characteristic curves for illustrating processes of fuel injection of the apparatus.

In the individual cylinders of the engine, processes of suction, compression, explosion, and exhaust are executed repeatedly. The pressure inside combustion chamber 13 of cylinder 11 varies in the manner shown in FIG. 3A, in which symbols A, B, C and D indicate ranges for the intake, compression, explosion, and exhaust processes, respectively.

Figure 3B:
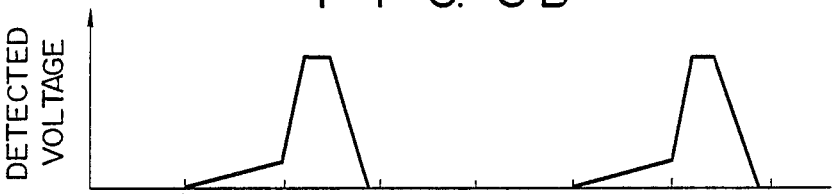

Thus, second piezoelectric device 26 in combustion chamber 13 produces the voltage as shown in FIG. 3B in response to the pressure inside chamber 13. This voltage is supplied, as a charge voltage, to first piezoelectric device 172, to extend the same.

In this case, diode 271 prevents first piezoelectric device 172 from being discharged. Even if the voltage delivered from second piezoelectric device 26 drops as the pressure inside combustion chamber 13 is lowered, therefore, the voltage applied to device 172 never changes, thus keeping device 172 extended.

When the explosion process ends, piston 171 of piezoelectric piston mechanism 17 in booster pump 15 is driven toward first fluid chamber 18, so that the fuel starts and keeps on flowing from chamber 18 to second fluid chamber 19.

Figure 3C:
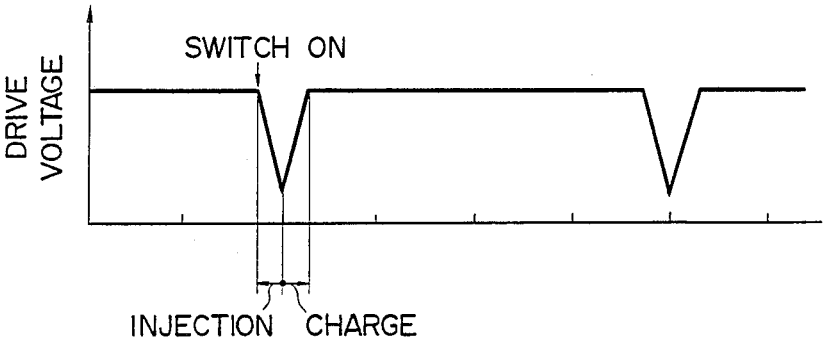

When switch element 272 is turned on in this state, first piezoelectric device 172 is discharged in accordance with a time constant which is determined by resistor 273, so that device 172 is contracted. The voltage applied to device 172 varies in the manner shown in FIG. 3C. The moment switch element 272 is turned on, the applied voltage lowers to cause piston 171 to be rapidly driven toward second fluid chamber 19. As piston 171 moves in this manner, the fuel is discharged from second fluid chamber 19, and injected into combustion chamber 13 via fuel injection valve 14. When the fuel injection ends, switch element 272 is opened, and high voltage is applied again to first piezoelectric device 172 to extend the same in the next explosion process.

Fuel discharge pressure P from second fluid chamber 19, obtained during the fuel injection, is given by $$P=P_0\times(S_1/S_2),$$

where $S_1$ is the pressure receiving area of piston 171 facing first fluid chamber 18, $S_2$ is that facing second fluid chamber 19, and $P_0$ is the discharge pressure of pressurizing pump 22. Thus, the fuel injection can be performed under a sufficiently high pressure.

In the process of fuel injection described above, booster pump 15 can also serve to control the quantity of fuel injection. The proper injection quantity is calculated by engine control unit 27 on the basis of a detection signal for the operating state of the engine. The voltage applied to first piezoelectric device 172 may be determined in accordance with an operation output indicative of the calculated injection quantity.

The extension of first piezoelectric device 172 and the location of piston 171 corresponding thereto depend on the voltage applied to device 172. Therefore, the contraction of device 172 or fuel delivery from second fluid chamber 19, obtained when switch element 272 is turned on, is determined by the voltage applied to device 172. Thus, the fuel injection control is executed in response to an instruction from engine control unit 27.

In the above embodiment, the source of high voltage applied to first piezoelectric device 172 is second piezoelectric device 26, which is set in each cylinder portion of the engine. In this apparatus, however, the fuel or other fluid is fed pressurized, not by the extension of the first piezoelectric device, but by the contraction thereof through the discharge of electricity from the device. Therefore, the power source for first piezoelectric device 172 need not specially have a large capacity, and may be formed of a battery such as is generally mounted on vehicles.

Figure 4:
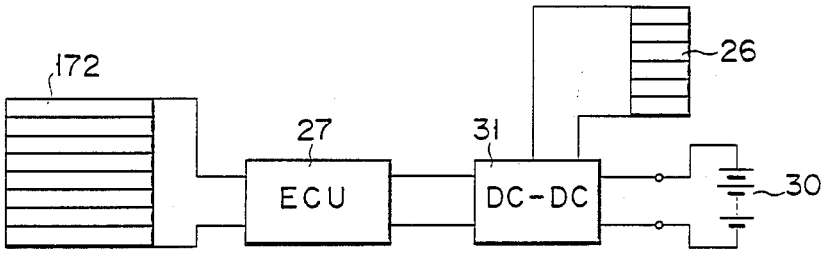
FIG. 4 is a diagram for illustrating another example of the power source for the piezoelectric device.

FIG. 4 shows an alternative embodiment of the invention, in which battery 30 is used as the power source. Voltage from battery 30 is boosted as required by means of DC-DC converter 31, and supplied to first piezoelectric device 172 through engine control unit 27.

Figure 5A:
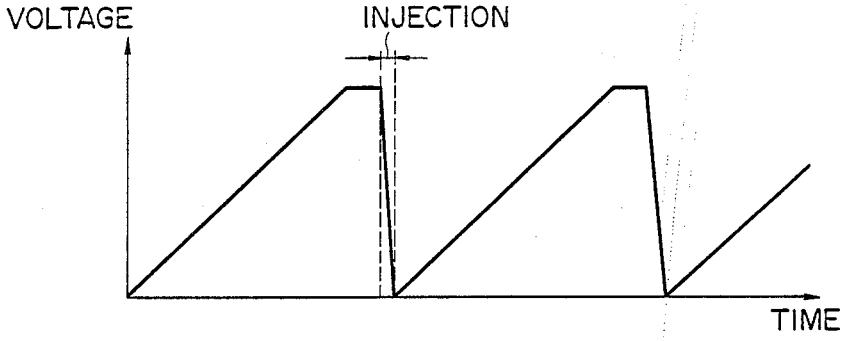
FIGS. 5A and 5B are diagrams showing modes of drive voltage supply for fuel injection and current supply to the piezoelectric device, respectively, obtained with use of the power source of FIG. 4.
Figure 5B:
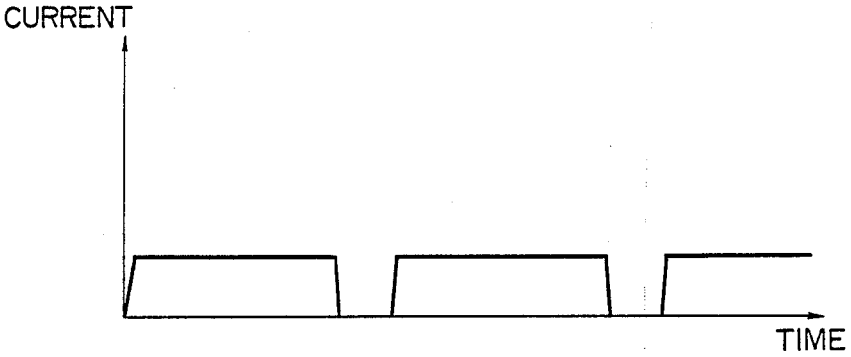

Thus, device 172 may be charged with drive voltage only slowly during the quiescent time between injection cycles, as shown in FIG. 5A. In this case, therefore, the charging current may be at only a very low level, as shown in FIG. 5B. In consequence, the battery-type power source of a relatively small capacity may be utilized effectively for the purpose.

The battery may be used in combination with second piezoelectric device 26, which has been described in connection with the foregoing embodiment. With this arrangement, even if the capacity of device 26 is relatively small, the piezoelectric piston mechanism of booster pump 15 can be controlled effectively for fuel injection.

In the embodiments described above, the fuel injection control is applied to a diesel engine. However, the booster pump system of the invention may also be used as high-pressure feeding means for various other fluids, e.g., as a spraying apparatus for a very small amount of liquid.

What is claimed is:

1. An apparatus for feeding a high-pressure fuel to an engine cylinder for injection control, comprising:

a cylinder chamber;

a piston movably located in the cylinder chamber to divide the cylinder chamber into first and second fuel chambers, so that the pressure receiving area of the piston facing the first fuel chamber is greater than that facing the second fuel chamber;

a first check valve located in a first fuel passage connecting with the first fuel chamber in the cylinder chamber, so that the high-pressure fuel is fed into the first fuel chamber through the first check valve;

a second check valve located in a second fuel passage connecting with the second fuel chamber;

a fuel injection valve adapated to inject the fuel into the engine cylinder and to be supplied with the high-pressure output fuel from the second fuel chamber;

a third check valve located in a third fuel passage connecting the first and second fuel chambers, whereby the fuel is allowed to flow only from the first fuel chamber to the second fuel chamber;

a first piezoelectric device adapted to be extended when a voltage is applied thereto and contracted when the applied voltage drops, so that the piston is moved toward the first fuel chamber when the piezoelectric device is extended, and that the piston is moved toward the second fuel chamber by the pressure inside the first fuel chamber when the piezoelectric device is contracted;

a high-voltage power source for producing a high voltage to be supplied to the first piezoelectric device so that the piezoelectric device is extended; and discharge control means for discharging, in response to a fuel injection timing, the high voltage applied to the first piezoelectric device, thereby contracting the piezoelectric device;

said cylinder chamber including a first cylinder portion and a second cylinder portion coaxial and continuous with the first cylinder portion and having an inside diameter sufficiently smaller than that of the first cylinder portion, and said piston includes a first piston member movable in the first cylinder portion along the axis thereof, and a second piston member integral and coaxial with the first piston member and movable in the second cylinder portion, said second piston member being fitted, on the outer peripheral surface thereof, with a cylindrical first piezoelectric device formed of a plurality of laminar, ring-shaped piezoelectric elements stacked in layers, said piezoelectric device being interposed between the first piston member and a stationary end face portion of the first cylinder portion located around the second cylinder portion.

2. An apparatus for injecting a high-pressure fuel into each cylinder of an engine, comprising:

a booster pump apparatus including a cylinder chamber, a piston movably located in the cylinder chamber to divide the cylinder chamber into first and second fuel chambers, so that the pressure-receiving area of the piston facing the first fuel chamber is greater than that facing the second fuel chamber, a first check valve located in a first fuel passage connecting with the first fuel chamber in the cylinder chamber, so that the high-pressure fuel is fed into the first fuel chamber through the first check valve, a second check valve located in a second fuel passage connecting with the second fuel chamber, a third check valve located in a third fuel passage connecting the first and second fuel chambers, whereby the fuel is allowed to flow only from the first fuel chamber to the second fuel chamber, and a first piezoelectric device adapted to be extended when a voltage is applied thereto and contracted when the applied voltage drops, so that the piston is moved toward the first fuel chamber when the piezoelectric device is extended, and that the piston is moved toward the second fuel chamber by the pressure inside the first fuel chamber when the piezoelectric device is contracted, whereby the high-pressure fuel fed into the first fuel chamber is delivered, under a further increased pressure, from the second fuel chamber via the second check valve when the piston moves toward the second fuel chamber as the first piezoelectric device is contracted;

a fuel injection valve adapted to inject the fuel into the engine cylinder and to be supplied with the high-pressure fuel from the second fuel chamber through the second check valve, so that fuel injection is executed as the high-pressure fuel is supplied;

a second piezoelectric device facing a combustion chamber in the engine cylinder and adapted to be subjected to a pressure produced during an explosion process of the combustion chamber, so that high-voltage power is generated in the second piezoelectric device and supplied to the first piezoelectric device, thereby extending the first piezoelectric device; and discharge control means for discharging, in response to a fuel injection timing, the high voltage applied to the first piezoelectric device, thereby contracting the piezoelectric device.

3. An apparatus according to claim 2, wherein said first piezoelectric device includes a plurality of laminar piezoelectric elements stacked in layers, and the piston is moved toward the first fuel chamber when the first piezoelectric device is executed, through being supplied with the high voltage.

4. An apparatus according to claim 2, wherein said second piezoelectric device includes a plurality of laminar piezoelectric elements stacked in layers, so that electric power generated in the second piezoelectric device is normally applied to the first piezoelectric device through a backflow-preventing element.

5. An apparatus for feeding high-pressure fuel into an engine cylinder for injection control, comprising:

a cylinder chamber;

a piston movably located in the cylinder chamber to divide the cylinder chamber into first and second fuel chambers, so that the pressure-receiving area of the piston facing the first fuel chamber is greater than that facing the second fuel chamber;

a first check valve located in a first fuel passage connecting with the first fuel chamber in the cylinder chamber, so that the high-pressure fuel is fed into the first fuel chamber through the first check valve;

a second check valve located in a second fuel passage connecting with the second fuel chamber, said second check valve defining an output fuel passage through which the fuel forced out of the second fuel passage is delivered as a high-pressure output fuel;

a fuel injection valve adapted to inject the fuel into the engine cylinder and to be supplied with the high-pressure output fuel from the second fuel passage;

a third check valve located in a third fuel passage connecting the first and second fuel chambers, whereby the fuel is allowed to flow only from the first fuel chamber to the second fuel chamber;

a piezoelectric device adapted to be extended when a voltage is applied thereto and contracted when the applied voltage drops, so that the piston is moved toward the first fuel chamber when the piezoelectric device is extended, and that the piston is moved toward the second fuel chamber by the pressure inside the first fuel chamber when the piezoelectric device is contracted; and control means for lowering, in response to a fluid output instruction, the voltage applied to the piezoelectric device;

said cylinder chamber including a first cylinder portion, and a second cylinder portion coaxial and continuous with the first cylinder portion and having an inside diameter sufficiently smaller than that of the first cylinder portion, and said piston including a first piston member movable in the first cylinder portion along the axis thereof, and a second piston member integral and coaxial with the first piston member and movable in the second cylinder portion.

6. An apparatus according to claim 5, wherein said piezoelectric device is formed of a laminate structure including a plurality of laminar piezoelectric elements stacked in layers, said laminate structure being interposed between the piston and a stationary member portion at that end portion of the cylinder chamber on the opposite side thereof to the first fuel chamber, whereby the piston is moved so that the capacity of the first fuel chamber varies with the state of extension of the laminate structure.

7. An apparatus according to claim 5, wherein said second piston member is fitted, on the outer peripheral surface thereof, with a cylindrical piezoelectric device formed of a plurality of laminar, ring-shaped piezoelectric elements stacked in layers, said piezoelectric device being interposed between the first piston member and a stationary end face portion of the first cylinder portion located around the second cylinder portion.

8. An apparatus according to claim 1, wherein said high-voltage power source includes a second piezoelectric device whose pressure-receiving surface faces a combustion chamber of the engine cylinder, with the fuel injection valve therein, and high-voltage power generated in the second piezoelectric device by a pressure produced during an explosion process of the combustion chamber is applied through a backflow-preventing element to the first piezoelectric device for driving the piston.

9. An apparatus according to claim 8, wherein said second piezoelectric device includes a plurality of laminar piezoelectric elements stacked in layers, and located in a chamber opening into the combustion chamber so that one face of the laminate assembly of the piezoelectric elements faces the combustion chamber.

10. An apparatus according to claim 1, wherein said high-voltage power source includes battery means and a converter for boosting an output voltage from the battery means, so that a high DC voltage from the converter is normally applied to the first p iezoelectric device and is discharged in accordance with the fuel injection timing.

11. An apparatus according to claim 1, wherein said high-voltage power source includes a second piezoelectric device whose pressure-receiving surface faces a combustion chamber of the engine cylinder with the fuel injection valve therein and a DC-DC converter for boosting the voltage of battery means, and high-voltage power generated in the second piezoelectric device by a pressure produced during an explosion process of the combustion chamber and high-voltage power generated in the DC-DC converter are applied to the first piezoelectric device.

12. An apparatus according to claim 11, wherein said second piezoelectric device includes a plurality of laminar piezoelectric elements stacked in layers, so that electric power generated in the assembly of the piezoelectric elements is normally applied to the first piezoelectric device through a backflow-preventing element, and that the high-voltage power from the DC-DC converter is also normally applied to the first piezoelectric device.

* * * * *